US005349908A

United States Patent [19]

Walz et al.

[11] Patent Number: 5,349,908

[45] Date of Patent: Sep. 27, 1994

[54] EXPLOSIVELY FORGED ELONGATED PENETRATOR

[75] Inventors: Mark Walz, Northboro; Richard J. Schoon, Southboro, both of Mass.

[73] Assignee: Nuclear Metals, Inc., Concord, Mass.

[21] Appl. No.: 11,996

[22] Filed: Feb. 1, 1993

[51] Int. Cl.[5] ..... F42B 1/02

[52] U.S. Cl. ..... 102/307; 102/309; 102/476

[58] Field of Search ..... 102/307, 309, 312, 476

[56] References Cited

U.S. PATENT DOCUMENTS

| | | | |
|---|---|---|---|
| 3,147,707 | 9/1964 | Caldwell | 102/24 |
| 4,498,367 | 2/1985 | Skolnick et al. | 86/1 R |
| 4,537,132 | 8/1985 | Sabranski et al. | 102/307 |
| 4,672,896 | 6/1987 | Precoul et al. | 102/309 |
| 4,702,171 | 10/1987 | Tal et al. | 102/476 |
| 5,033,387 | 7/1991 | Lips | 102/475 |
| 5,251,561 | 10/1993 | Murphy | 102/307 |
| 5,259,317 | 11/1993 | Lips | 102/307 |

*Primary Examiner*—Peter A. Nelson

*Attorney, Agent, or Firm*—Joseph S. Iandiorio; Kirk Teska

[57] ABSTRACT

An explosively forged elongated penetrator including a liner having a central section, an intermediate section and a peripheral section; the axial velocity of the sections being approximately equal; the axial thicknesses of the sections decreasing from the central to the peripheral section; the radial velocity increasing from the central to the peripheral section; and the line profile angle decreasing from the central to the peripheral section, to define an explosively driven, inwardly directed, centrally focused force for forging the penetrator from the liner substantially independently of the axial velocities.

30 Claims, 8 Drawing Sheets

AXIAL VELOCITY

| | $V_{X1} \simeq V_{X2} \simeq V_{X3}$ | $V_1 > V_2 > V_3$ | $V_1 < V_2 < V_3$ |
|---|---|---|---|
| W-FOLD SPHERE | | X | |
| PT-FOCUS SPHERE | X | | |
| REARWARD FOLD ROD | | X | |
| FORWARD FOLD ROD | | | X |
| PT-FOCUS ROD | X | | |

AXIAL THICKNESS

| | $H_1 = H_2 = H_3$ | $H_1 < H_2 > H_3$ | $H_1 > H_2 > H_3$ | $H_1 < H_2 > H_3$ |
|---|---|---|---|---|
| W-FOLD SPHERE | | X | | |
| PT-FOCUS SPHERE | X | | | |
| REARWARD FOLD ROD | | | | X |
| FORWARD FOLD ROD | | | X | |
| PT-FOCUS ROD | | | X | |

| | RADIAL VELOCITY | | LINE PROFILE | |
|---|---|---|---|---|
| | $V_1 < V_2 < V_3$ | $V_1 < V_2 > V_3$ | $\alpha_1 > \alpha_2 > \alpha_3$ | $\alpha_1 > \alpha_2 < \alpha_3$ |
| W-FOLD SPHERE | X | | X | |
| PT-FOCUS SPHERE | X | | X | |
| REARWARD FOLD ROD | | X | | X |
| FORWARD FOLD ROD | X | | X | |
| PT-FOCUS ROD | X | | X | |

Fig. 14

EXPLOSIVELY FORGED ELONGATED PENETRATOR

FIELD OF INVENTION

This invention relates to an explosively forged elongated penetrator, and more particularly to such an explosively forged penetrator interactively integratable with a local impediment.

BACKGROUND OF INVENTION

Current anti-armor ordnance employ explosively formed elongated penetrators for piercing armored vehicles and equipment. Such penetrators are generally one of two types: rearward folding or forward folding. In forward folding types a warhead containing an explosive charge drives the periphery of a metal plate, referred to as a liner, forward with an axial velocity greater than the axial velocity of the central portion causing the periphery to fold over and converge forward of the central portion and form an elongated penetrator. In rearward folding the explosive charge drives the periphery of the liner forward with an axial velocity less than the axial velocity of the central portion causing the periphery to fold over and converge rearward of the central portion to form the elongated penetrator. In these approaches, then, the axial velocity component is critical in determining the final desired shape of the penetrator and this is a well accepted technique. However, in certain applications, for example, where the explosively formed penetrator is delivered from the warhead assembly of a missile or projectile, the explosively formed penetrator encounters the skin of the missile or projectile during the critical earlier stages when the liner is being formed into the penetrator shape by the folding action of the periphery over the center. The engagement of the liner with the skin radically alters the axial velocities of the periphery thereby disrupting the folding. This disruption of the forming process causes the penetrator to fragment or otherwise lose its effectiveness as a penetrator. To avoid this, provision is made to remove the impeding portion of the skin using clearing charges or skin just prior to the liner folding action cutting devices which significantly increase the cost and complexity of the systems.

SUMMARY OF INVENTION

It is therefore an object of this invention to provide an improved penetrator by explosively forging an elongated penetrator.

It is a further object of this invention to provide such an improved explosively forged elongated penetrator which relies on radial velocity components to shape the penetrator independent of axial velocity components.

It is a further object of this invention to provide such an improved explosively forged elongated penetrator which forges, not forms or folds, the liner to create the elongated penetrator.

It is a further object of this invention to provide such an improved explosively forged elongated penetrator which can be easily interactively integrated with local impediments to maintain the radial forging process and minimize the effects of any variation in axial velocity on the desired final shape of the penetrator.

The invention results from the realization that the failure of the penetrator formation in conventional explosively formed elongated penetrators was caused by the effect of the local impediment (such as the missile or projectile skin) on the relative axial velocities of the center and peripheral portions of the forming liner and that by forging a liner toward a central focus using radial velocities to shape the penetrator, the penetrator could be interactively integrated with the local impediment to obtain the final desired elongated penetrator shape.

This invention features an explosively forged elongated penetrator including a liner having a central section, an intermediate section and a peripheral section. The axial velocity of the sections is approximately equal. The axial thickness of the sections decreases from the central to the peripheral section. The radial velocity increases from the central to the peripheral section, and the line profile angle decreases from the central to the peripheral section. This defines an inwardly directed centrally focused force for forging the penetrator from the liner of substantially independently of the axial velocities.

In a preferred embodiment the liner may have two surfaces, a convex surface and a concave surface. The liner may be crescent shaped and may be concave in the direction of forward motion of the penetrator. The surfaces may be circular arcs or they may be defined by a quadratic equation of the sixth order, for example. The axial velocities of the central, intermediate and peripheral sections may be in the range from 2 km/sec to 3 km/sec, 2 km/sec to 3 km/sec, and 2 km/sec to 3 km/sec, respectively. The axial thicknesses at the central, intermediate and peripheral sections may be from 0.15 cm to 0.51 cm, 0.13 cm to 0.46 cm, and 0.07 cm to 0.38 cm, respectively. The radial velocities of the central, intermediate and peripheral sections may be from 0 km/sec to 0.1 km/sec, 0.3 km/sec to 0.5 km/sec, and 0.4 km/sec to 0.7 km/sec, respectively; and the line profile angles at the central, intermediate and peripheral sections may be from 90° to 80°, 80° to 60°, and 80° to 50°, respectively.

The invention also features an explosively forged elongated penetrator system which includes a case, an explosive initiation train mounted to the back of the case, and a liner mounted to the front of the case. There is an explosive charge in the case between the explosive initiation train and the liner. The liner has a central section, an intermediate section and a peripheral section. The axial velocities of the sections is approximately equal. The axial thicknesses of the sections and the radial velocities of the sections increases from the central to the peripheral sections. The line profile angle decreases from the central to the peripheral sections. This defines an inwardly directed, centrally focused force for forging the penetrator from the liner substantially independently of the axial velocities.

The invention also features an integrated interactive local warhead impediment and explosively forged penetration system including a warhead assembly, a case, an explosive initiation train mounted to the back of the case, and a liner mounted to the front of the case disposed between the case and the warhead assembly. The liner has a central section, an intermediate section and a peripheral section. The axial velocity of the sections is approximately equal. The axial thickness decreases and the radial velocity of the sections increases from the central to the peripheral section. The line profile angle decreases from the central to the peripheral section. This defines an inwardly directed, centrally focused force for forging the penetrator from the liner substantially independently of the axial velocities.

DISCLOSURE OF PREFERRED EMBODIMENT

Other objects, features and advantages will occur to those skilled in the art from the following description of a preferred embodiment and the accompanying drawings, in which.

Figure 12:
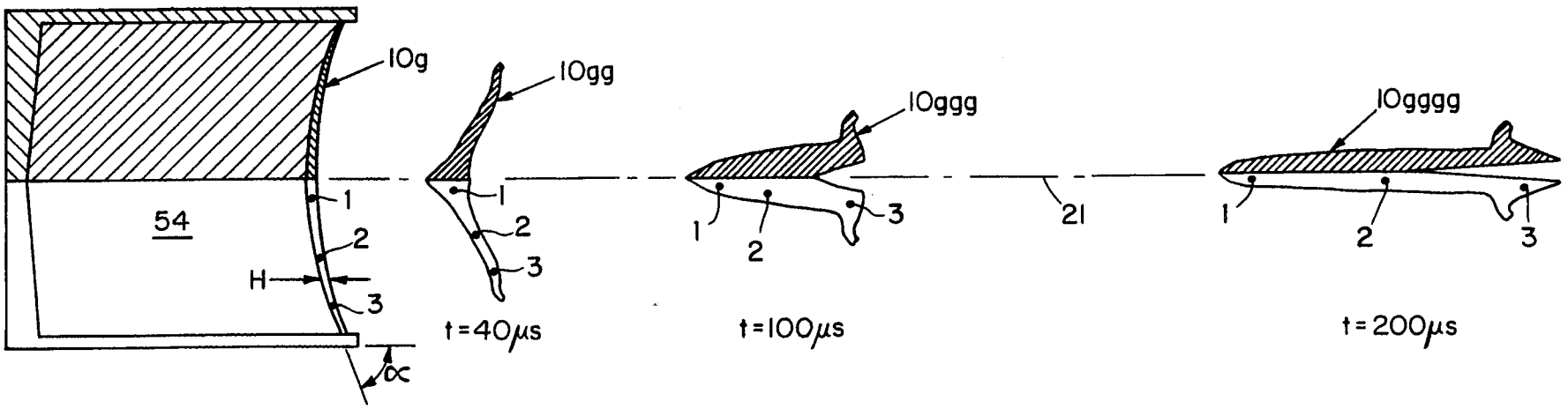
Fig. 12 PRIOR ART
Figure 13:
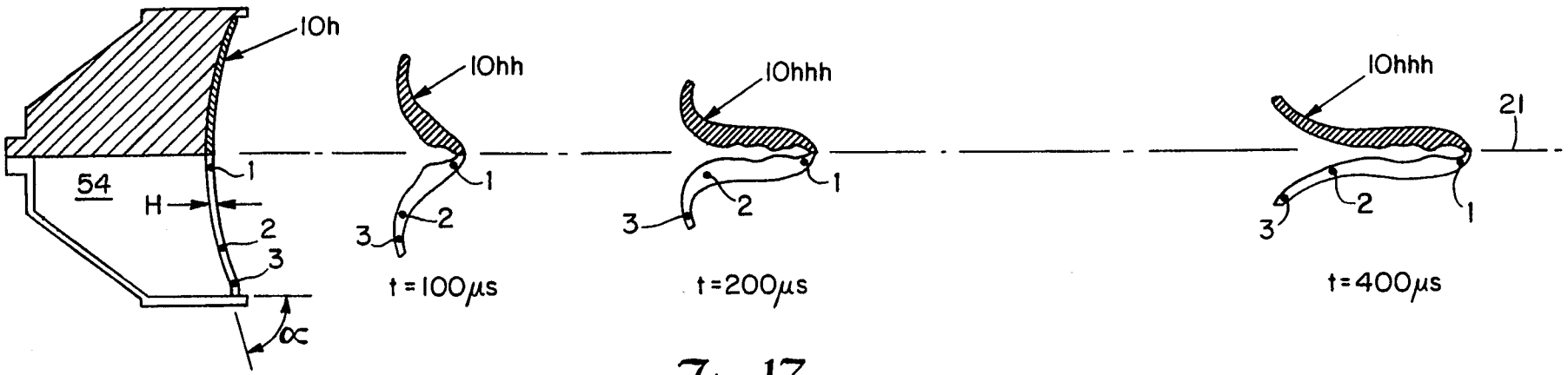
Fig. 13 PRIOR ART

FIG. 12 is a side schematic sequential view of a prior art elongated or long rod formation using a forward fold liner; and FIG. 13 is a side schematic sequential view of a prior art elongated or long rod projectile of formation using a rearward fold liner; and FIG. 14 is a comparison chart showing the initial conditions of axial velocity, axial thickness, radial velocity and liner profile for each of the four prior art systems of FIGS. 10–13 and the device according to this invention.

This invention may be accomplished with an explosively forged penetrator including a liner having a central section, an intermediate section and a peripheral section. The liner may be made of any ductile material such as tantalum, copper, aluminum, steel, depleted uranium, iron or plastic. The liner can be initially curved, and may have converging curved surfaces which result in a crescent-shaped cross section. The curved surfaces may each be a single radius or a series of radii, or the surfaces may be described by a quadratic expression. The surfaces may be concave in the forward direction of travel and convex in the rearward direction. The peripheral section of the liner has substantially the same axial velocity as the central and intermediate sections so that the axial velocities are not depended upon for the shaping of the liner into the final elongated penetrator form. The axial velocity simply moves the liner/penetrator forward. There is, however, a radial velocity which defines an inwardly directed, centrally focussed force for forging the penetrator from the liner substantially independently of the axial velocities. Thus by forging the liner into the penetrator using radial motions and forces instead of folding or forming the liner into the penetrator using substantial axial motions and forces, the liner can be made to form an effective elongated penetrator even in the presence of an impediment which can alter the axial velocities of the peripheral section relative to the central section and disrupt the proper formation of the penetrator.

Figure 1:
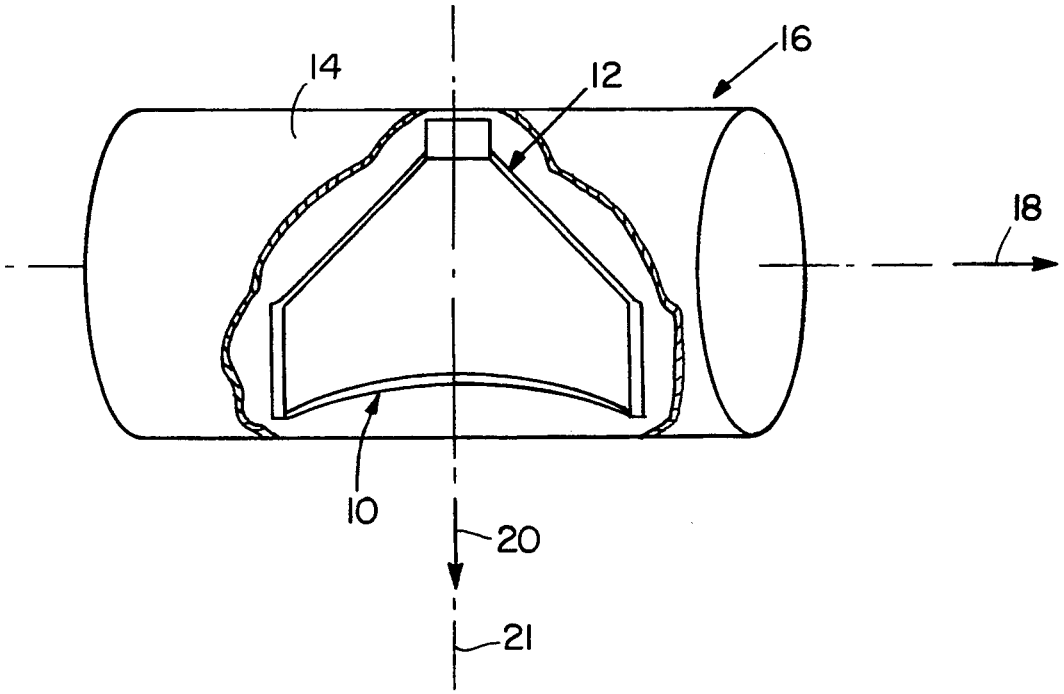
FIG. 1 is a schematic view with portions broken away showing the explosively forged penetrator according to this invention in a warhead in a side-firing missile or projectile.

There is shown in FIG. 1 a liner or penetrator 10 in a warhead 12 mounted within the skin 14 of a projectile or missile 16. Missile 16 is moving in the direction of arrow 18 but warhead 12 is a side firing system which fires liner 10 in the direction of arrow 20 along primary longitudinal axis 21. Liner 10 is the initial stage of the penetrator which is formed when the warhead is fired and the explosive forces are applied to liner 10.

Figure 2:
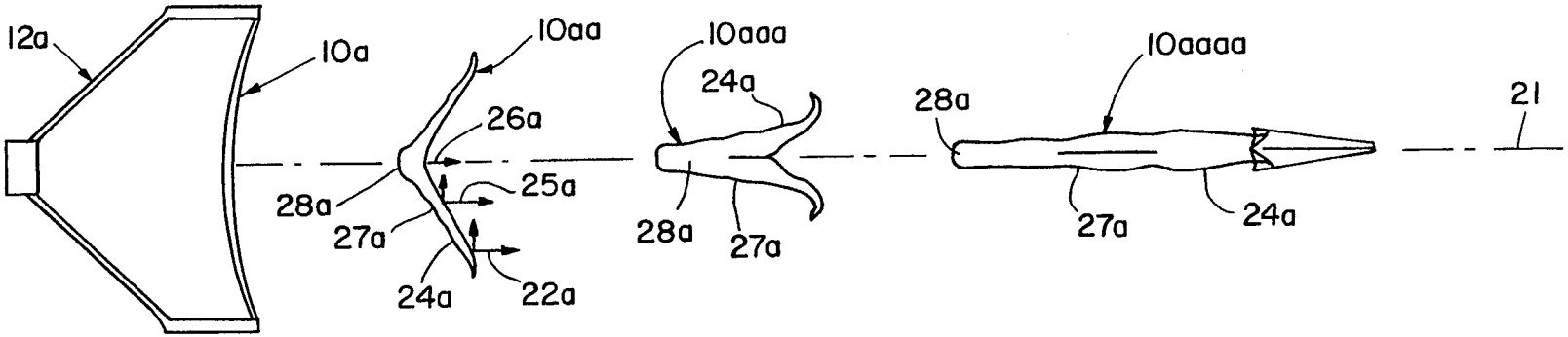
Fig. 2 PRIOR ART
FIG. 2 is a side, schematic, sequential view of a prior art warhead showing the formation of a penetrator of the forward fold type.
Figure 3:
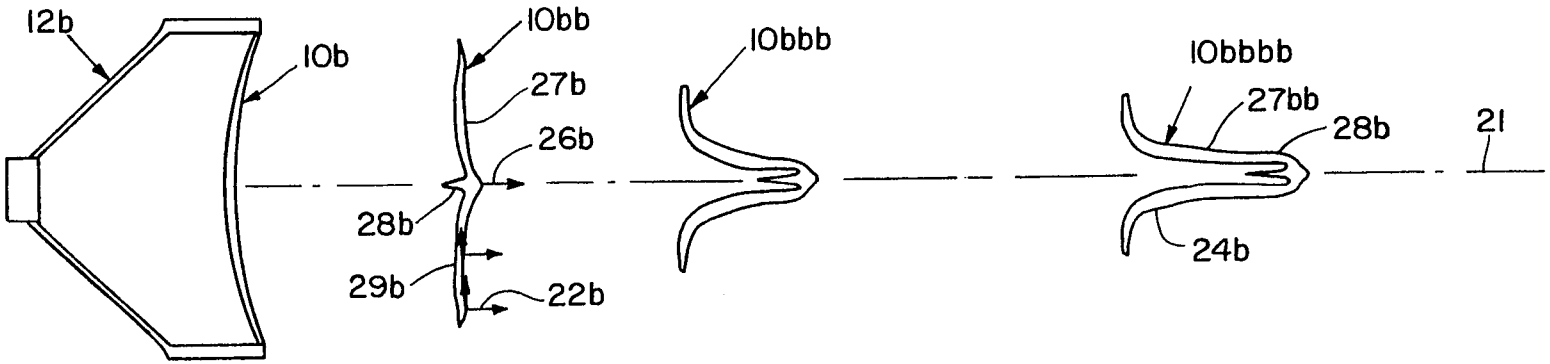
Fig. 3 PRIOR ART
FIG. 3 is a side, schematic sequential view of a prior art warhead similar to FIG. 2 showing the formation of a penetrator of the rearward fold type.

This can better be understood with reference to the prior art shown in FIGS. 2 and 3. In FIG. 2, warhead 12*a* is firing a so-called forward fold liner 10*a* which immediately after the explosion begins to form penetrator 10*aa*. Penetrator 10*aa* can be seen to have axial velocity 22*a* at its peripheral section 24*a* which is substantially larger than the axial velocity 25*a* at intermediate section 27*a* which in turn is larger than the axial velocity 26*a* at central section 28*a*. This causes the peripheral section 24*a* to fold over, forming an intermediate shape, penetrator 10*aaa*. In the final form, peripheral section 24*a* closes down to form the final penetrator 10*aaaa*.

In the prior art rear-folding device, warhead 12*b*, FIG. 3, begins to form liner 10*b* with the explosion. However, in this rear-folding system the axial velocities 22*b* of peripheral section 24*b* are less than the axial velocity 26*b* of central section 28*b*. This causes the peripheral section 24*b* of penetrator 10*bb* to begin to lag central section 28*b*, rendering the intermediate penetrator 10*bbb* and ultimately the final penetrator 10*bbbb*.

Figure 4:
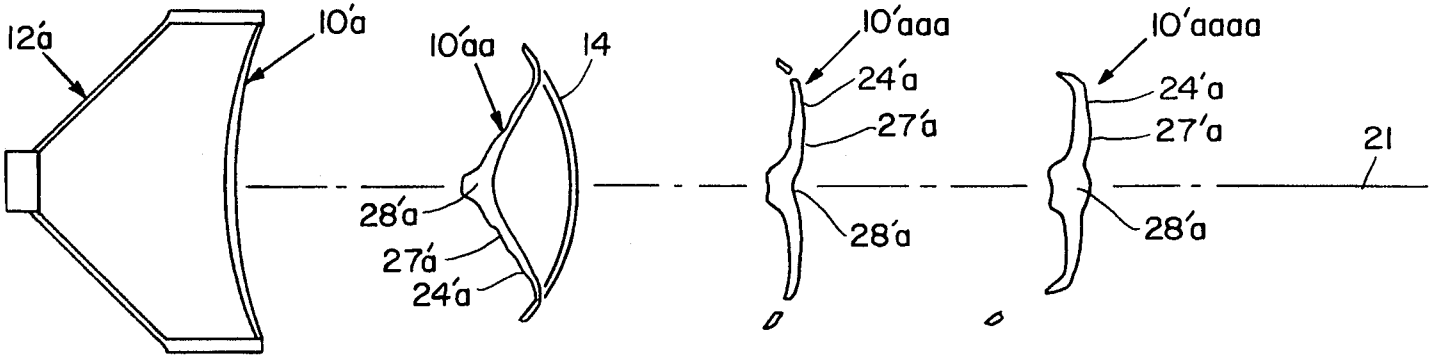
Fig. 4 PRIOR ART
FIG. 4 is a view similar to FIG. 2 where the forward fold forming penetrator has encountered a local impediment such as the missile or projectile skin.
Figure 5:
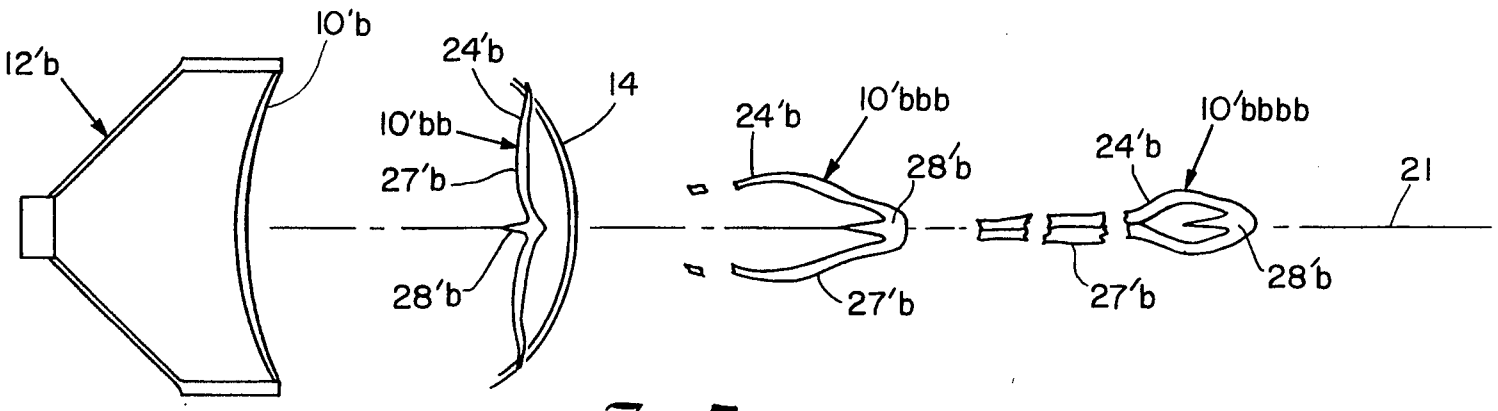
Fig 5 PRIOR ART
FIG. 5 is a view similar to FIG. 4 showing the effect of the impediment on a rearward fold forming penetrator such as shown in FIG. 3.

While these prior art forward, FIG. 2, and rearward, FIG. 3, folding techniques work for explosively formed penetrators in general use, they fail when there is present a local impediment, for example the skin 14 of projectile or missile 16. This is explained with reference to FIGS. 4 and 5. In FIG. 4 the prior art forward-fold technique is used. There warhead 12'*a* begins with liner 10'*a*. After firing, as penetrator 10'*aa* is formed, the peripheral section 24'*a* still leads the central section 28'*a* in terms of axial velocity so that the forward fold begins to form. However, when penetrator 10'*aa* strikes the impediment, e.g., skin 14, the axial velocity of the peripheral section 24'*a* of penetrator 10'*aaa* slows and approaches the axial velocity of central section 28'*a*. This disrupts and prevents the forward folding action dependent primarily on the axial velocity differentials and causes penetrator 10'*aaa* and the final form 10'*aaaa* to fragment and become ineffective as a penetrator. A similar result occurs when warhead 12'*b*, FIG. 5, is fired. In this rearward fold approach, when penetrator 10'*bb* strikes the impediment, skin 14, the peripheral section 24'*b* has its axial velocity decreased even more than it already is over the axial velocity of center section 28'*b*. This results in the peripheral sections 24'*b* of penetrator 10'*bbb* whipping together with excessive differential axial speed with respect to central section 28'*b* so that there is fragmentation as shown more clearly with respect to penetrator 10'bbbb, which renders the penetrator ineffective.

Figure 6:
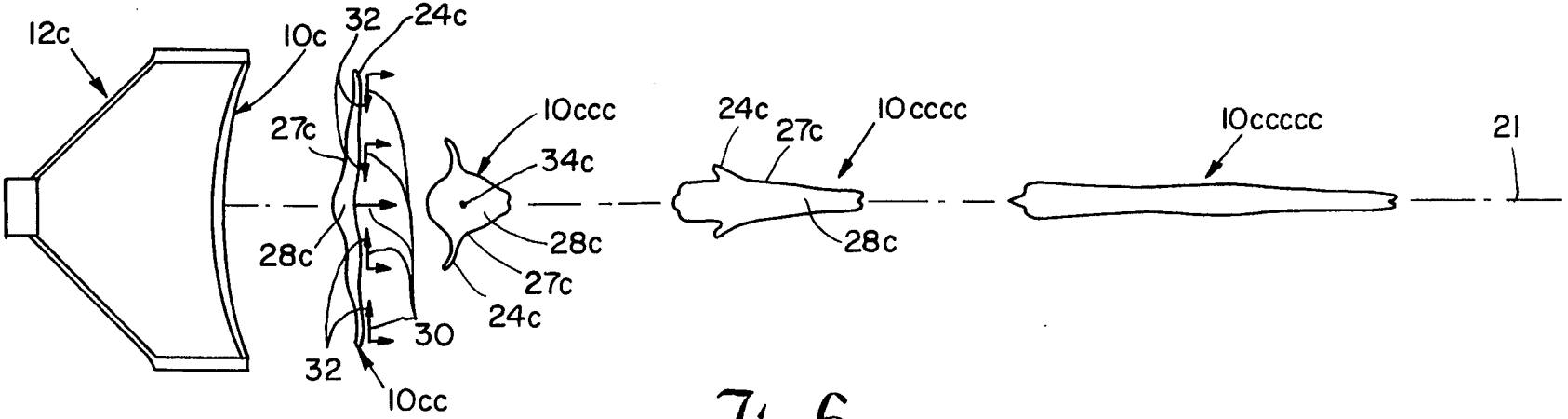
FIG. 6 is a side, schematic, sequential view of the explosively forged penetrator according to this invention illustrating the forging process effected by the radial velocities.
Figure 7:
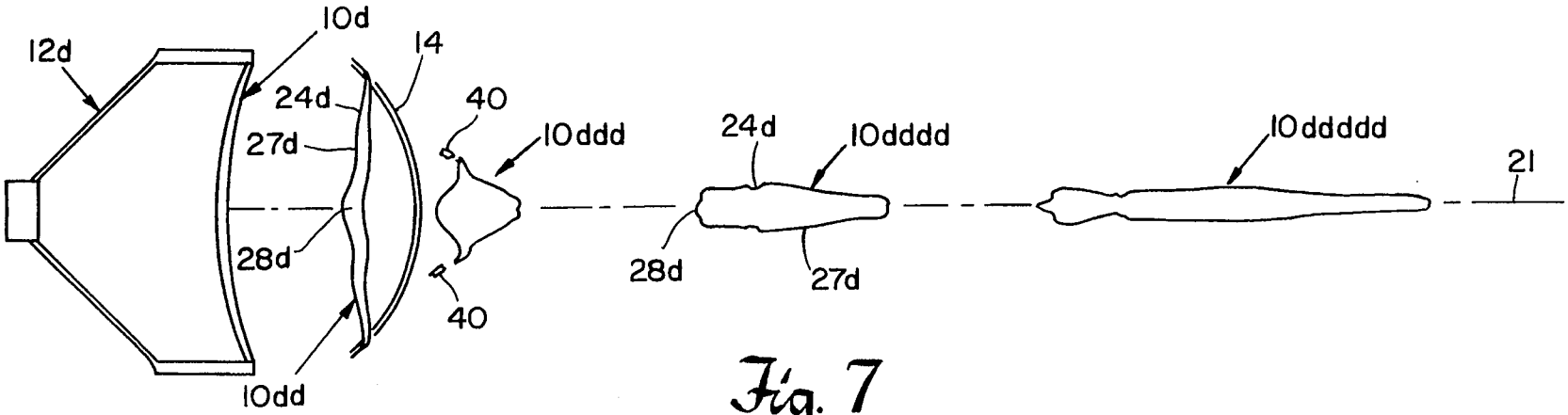
FIG. 7 is a view similar to FIG. 6 but illustrating the effect of the local impediment on the forging of the penetrator.

In accordance with this invention, as shown in FIG. 6, warhead 12c imposes on liner 10c axial velocities 30c which are essentially the same throughout the peripheral section 24c, intermediate section 27c and central section 28c. The radial velocities 32c, however, are inwardly directed to forge, as opposed to form or fold, penetrator 10cc so that it is forged into a penetrator 10ccc. The radial velocities are focussed at a central point 34c to effect the forging. The inwardly directed radial forces continue to forge and compress penetrator 10cccc radially inwardly so that it begins to elongate in the axial direction both forwardly and rearwardly along the longitudinal axis, resulting in final penetrator 10ccccc. Because it is the radial velocities that forge the shape of the penetrator and not the axial velocities, the presence of an impediment, skin 14, as shown in FIG. 7, does not significantly interfere with the proper formation of a penetrator. When liner 10d, FIG. 7, begins to form, penetrator 10dd strikes impediment 14 and although the peripheral section 24d may be slowed earlier in time than the center 28d, there is no overall effect on the forging process because given the high axial velocity, the time interval between the peripheral section 24d hitting skin 14 and the central section 28d hitting skin 14, is only a matter of 10–20 microseconds, and the maximum curvature induced would be only a few millimeters, not enough to change the forging process. Thus after striking impediment 14 penetrator 10ddd has only a tiny insignificant fragmentation 40 which does not affect the overall formation of penetrator 10dddd. It can be seen by comparing FIG. 7 to FIG. 6 that the only difference is a slight flattening or indentation in the area of peripheral section 24d, and the final forged penetrator 10ddddd has essentially the same shape as that of FIG. 10ccccc.

Figure 8:
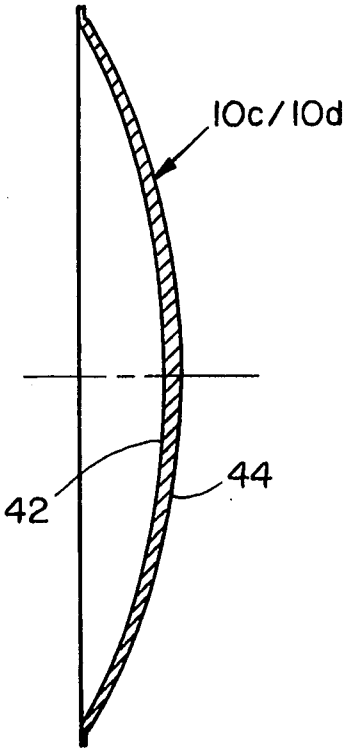
FIG. 8 is an enlarged detail view of a liner according to this invention.

The particular liner 10c, 10d according to this invention, is shown in greater detail in FIG. 8, where both the forward concave surface 42 and the rearward convex surface 44 are defined by the quadratic equation:

$$X=A+BY+CY^2+DY^3+EY^4+FY^5+GY^6$$

where the polynomial coefficients are defined as follows:

| | POLYNOMIAL COEFFICIENTS (IN.) | |
|---|---|---|
| | CONVEX | CONCAVE |
| A | 0.0000000 | 0.0899817 |
| B | 0.0000000 | −0.0001962 |
| C | 0.1625084 | 0.1573543 |
| D | −0.0926159 | −0.1078849 |
| E | 0.0696729 | 0.0954792 |
| F | −0.0230796 | −0.0358413 |
| G | 0.0023663 | 0.0043595 |

Figure 9:
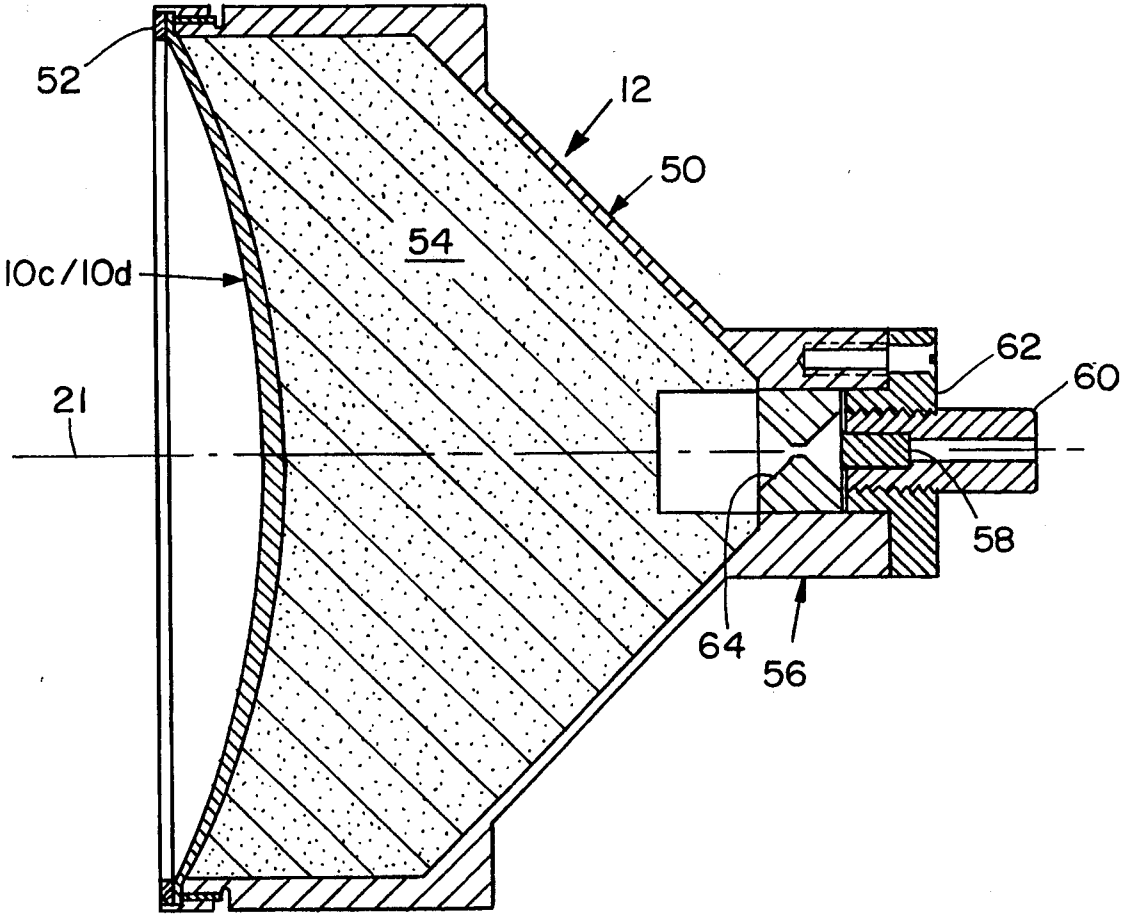
FIG. 9 is a side elevational schematic cross-sectional view of an explosively forged penetrator warhead according to this invention.

The liner 10c/10d is mounted in warhead 12, FIG. 9, which contains a case 50 including a retainer ring 52 with an explosive charge 54 such as LX-14 or OCTOL, composition B, or any other energetic high-detonation velocity explosive. At the back of case 50 is an explosive initiation train 56 which includes detonator 58 in detonator holder 60 mounted in detonator keeper 62. Between detonator 58 and the explosive charge 54 is the precision initiation coupler 64.

The formation of explosively shaped projectiles is a very sophisticated and subtle art. The contribution of this invention can better be appreciated through an understanding of the various prior art approaches and the attendant variables.

Generally there are two types of formation types: the compact ball and the elongated or long rod as discussed, supra, with respect to FIGS. 2–5. The compact ball projectiles are formed with a "W" fold approach in which the explosive-liner design creates a "W" shaped liner that collapses upon itself, or a point focus approach in which all the liner material is focused to one point. The elongated, long rod projectiles are formed either by forward fold, FIGS. 2 and 4, or rearward fold, FIGS. 3 and 5, approaches.

Figure 10:
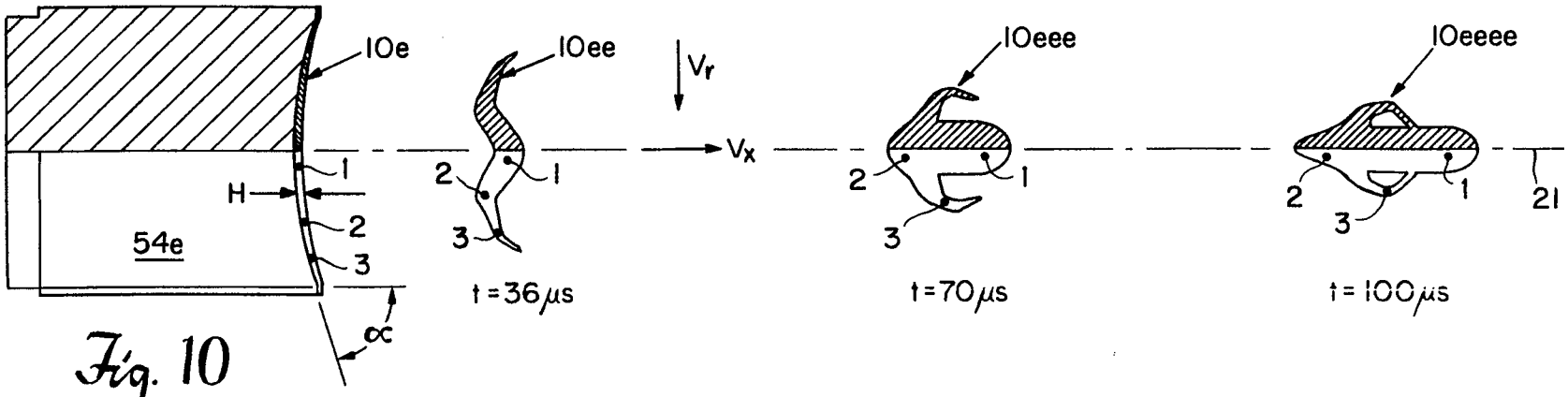
Fig. 10 PRIOR ART
FIG. 10 is a side schematic sequential view of a prior art compact ball formation using a "W" fold liner.
Figure 11:
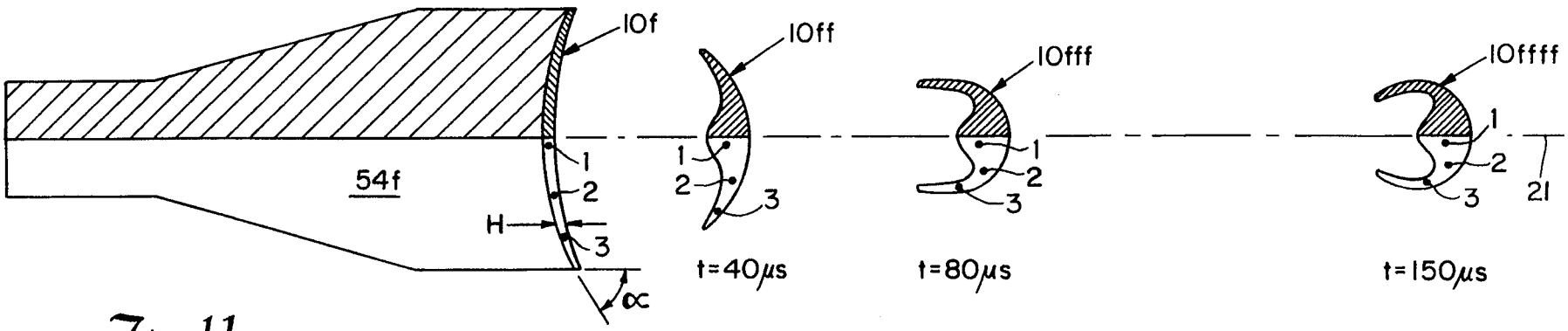
Fig. 11 PRIOR ART
FIG. 11 is a side schematic sequential view of a prior art compact ball formation using a point focus liner.

The "W" fold liner formation is depicted in FIG. 10, where the liner 10e is shown changing shape at three different times after detonation: 36 microseconds, 70 microseconds, and 100 microseconds, as indicated by the shapes 10ee, 10eee and 10eeee, respectively. The primary variables in this formation are the axial velocity $V_x$, the axial thickness H, the radial velocity $V_r$, and the line profile $\alpha$. By viewing the liner 10e in three sections numbered 1, 2 and 3, with 1 being the closest to the center, 3 being the most peripheral, and 2 being the intermediate section or area, the relationship of the four variables for those three sections or areas occur as follows: the axial velocity $V_{x1}>V_{x2}<V_{x3}$; axial thickness $H_1<H_2>H_3$; radial velocity $V_{R1}<V_{R2}<V_{R3}$; and liner profile $\alpha_1>\alpha_2>\alpha_3$. In a point focus liner formation, FIG. 11, where like parts have been given like numbers accompanied by a lower case f, liner 10f is shown at the times 40 microseconds, 80 microseconds and 150 microseconds after detonation, as indicated by shapes 10ff, 10fff, 10ffff, respectively. Here the relative variables have a different relationship: axial velocity $V_{x1}\approx V_{x2}\approx V_{x3}$; axial thickness $H_1=H_2=H_3$; radial velocity $V_{R1}<V_{R2}<V_{R3}$; and line profile $\alpha_1>\alpha_2>\alpha_3$.

The forming of an elongated projectile by forward fold liner formation is depicted in FIG. 12 where the liner shapes 10gg, 10ggg, 10gggg represent the shape at times 40 microseconds, 100 microseconds and 200 microseconds after detonation. Here the relative variables take on yet another relationship: axial velocity: $V_{x1}<V_{x2}<V_{x3}$; axial thickness: $H_1>H_2>H_3$; radial velocity: $V_{R1}<V_{R2}<V_{R3}$; line profile: $\alpha_1>\alpha_2>\alpha_3$.

Finally, for a rearward liner formation of the elongated projectile, liner 10h takes the shapes as indicated at 10hh, 10hhh and 10hhhh, FIG. 13, at the times 100 microseconds, 200 microseconds, and 400 microseconds after detonation. Here again the variables have a different relationship: axial velocity: $V_{x1}>V_{x2}>V_{x3}$; axial thickness: $H_1<H_2$; however, $H_3<H_2$ due to confinement condition; radial velocity: $V_{R1}<V_{R2}>V_{R3}$; and line profile $\alpha_1<\alpha_2<\alpha_3$.

In accordance with this invention these parameters have the relationship as follows: the initial axial velocity $V_{x1}\approx V_{x2}\approx V_{x3}$; the initial axial thickness $H_1>H_2>H_3$; the initial radial velocity $V_{R1}<V_{R2}<V_{R3}$; and the initial line profile $\alpha_1>\alpha_2>\alpha_3$. A comparison of these variables for each of the four prior art devices shown in FIGS. 10, 11, 12 and 13, with those of this invention, is shown in FIG. 14, where it can be seen that the point focus rod, as opposed to the W folded sphere and point focus sphere and the rearward and forward folding rods, is distinct in that it is the only one in which the initial axial velocities are approximately equal; the axial thickness decreases from the innermost area $H_1$ to the outermost area $H_3$; the radial velocity increases from the innermost area $V_{r1}$ to the outermost area $V_{r3}$; and the line profile angle decreases from the innermost area $\alpha_1$ to the outer area $\alpha_3$. It is these subtle distinctions which produce the radical difference in the local impediment immune formation of the final elongated rod.

The specific values for the variables in a 137 mm diameter warhead according to this invention am: axial velocities $V_{x1}=2.25$ km/sec, $V_{x2}=2.27$ km/sec, $V_{x3}=2.11$ km/sec; axial thicknesses $H_1=0.229$ cm, $H_2=0.212$ cm, $H_3=0.180$ cm; radial velocities $V_{r1}=0$ km/sec, $V_{r2}=0.40$ km/sec, $V_{r3}=0.56$ km/sec; and linear profile angles $\alpha_1=88°$, $\alpha_2=77°$, $\alpha_3=70°$. These values have been used to demonstrate the subject invention in a warhead of 137 mm diameter. When the invention is applied to warheads of larger and smaller diameter all values will remain similar except for axial thickness. Axial thickness of the liner will determine the explosive energy to liner mass ratio which impacts axial and radial velocities. Therefore, when the warhead diameter is changed, the liner axial thickness will have to be altered more than other attributes in order to keep axial velocities approximately equal and to achieve the relative radial velocities necessary to obtain a point focus elongated rod.

One striking difference between this invention and prior art devices is that the forging process which drives the liner radially inward provides an axial forming force along the primary longitudinal axis 15 in both senses of direction 20 forward and rearward. This is so because the increased radial forces applied according to this invention generate greater heat, internal to the liner, which more fully plasticizes the material so that it flows in both directions, forward and backward, to form the final elongated rod or projectile.

Although specific features of this invention are shown in some drawings and not others, this is for convenience only as some feature may be combined with any or all of the other features in accordance with the invention.

Other embodiments will occur to those skilled in the art and are within the following claims:

What is claimed is:

1. An explosively forged elongated penetrator comprising:

a liner having a central section, an intermediate section and a peripheral section; the axial velocity of said sections being approximately equal, the axial thickness of said sections decreasing from the central to the peripheral section; the radial velocity increasing from the central to the peripheral section; and the line profile angle decreasing from the central to the peripheral section; to define an inwardly directed centrally focused force for forging the penetrator from the liner substantially independently of the axial velocities.

2. The explosively forged elongated penetrator of claim 1 in which said liner has two surfaces, a convex surface and a concave surface.

3. The explosively forged elongated penetrator of claim 2 in which said liner is crescent shaped.

4. The explosively forged elongated penetrator of claim 2 in which said liner is concave in the direction of forward motion of the penetrator.

5. The explosively forged elongated penetrator of claim 2 in which said surfaces are circular arcs.

6. The explosively forged elongated penetrator of claim 2 in which said surfaces are defined by a sixth order quadratic equation.

7. The explosively forged elongated penetrator of claim 1 in which said axial velocities at the central, intermediate and peripheral sections are from 2 km/sec to 3 km/sec, 2 km/sec to 3 km/sec, and 2 km/sec to 3 km/sec, respectively.

8. The explosively forged elongated penetrator of claim 1 in which said axial thicknesses at the central, intermediate and peripheral sections are from 0.15 cm to 0.51 cm, 0.13 cm to 0.46 cm, and 0.07 cm to 0.38 cm.

9. The explosively forged elongated penetrator of claim 1 in which said radial velocities at the central, intermediate and peripheral sections are from 0 km/sec to 0.1 km/sec, 0.3 km/sec to 0.5 km/sec, and 0.4 kin/see to 0.7 kin/sec.

10. The explosively forged elongated penetrator of claim 1 in which said line profile angles at the central, intermediate and peripheral sections are from 90° to 80°, 80° to 60°, and 80° to 50°.

11. An explosively forged elongated penetrator comprising:

a case;

an explosive initiation train mounted to the back of the case;

a liner mounted at the front of the case;

an explosive charge in said case between said explosive initiation train and said liner; said liner having a central section, an intermediate section and a peripheral section; the axial velocity of said sections being approximately equal, the axial thickness of said sections decreasing from the central to the peripheral section; the radial velocity increasing from the central to the peripheral section; and the line profile angle decreasing from the central to the peripheral section; to define an inwardly directed centrally focused force for forging the penetrator from the liner substantially independently of the axial velocities.

12. The explosively forged elongated penetrator of claim 11 in which said liner has two surfaces, a convex surface and a concave surface.

13. The explosively forged elongated penetrator of claim 12 in which said liner is crescent shaped.

14. The explosively forged elongated penetrator of claim 12 in which said liner is concave in the direction of forward motion of the penetrator.

15. The explosively forged elongated penetrator of claim 12 in which said surfaces are circular arcs.

16. The explosively forged elongated penetrator of claim 12 in which said surfaces are defined by a sixth order quadratic equation.

17. The explosively forged elongated penetrator of claim 11 in which said axial velocities at the central, intermediate and peripheral sections are from 2 km/sec to 3km/sec, 2 km/sec to 3 km/sec, and 2 km/sec to 3 km/sec, respectively.

18. The explosively forged elongated penetrator of claim 11 in which said axial thicknesses at the central, intermediate and peripheral sections are from 0.15 cm to 0.51 cm, 0.13 cm to 0.46 cm, and 0.07 cm to 0.38 cm.

19. The explosively forged elongated penetrator of claim 11 in which said radial velocities at the central, intermediate and peripheral sections are from 0 km/sec to 0.1 km/sec, 0.3 km/sec to 0.5 km/sec, and 0.4 km/sec to 0.7 km/sec.

20. The explosively forged elongated penetrator of claim 11 in which said line profile angles at the central, intermediate and peripheral sections are from 90° to 80°, 80° to 60°, and 80° to 50°.

21. An integrated, interactive local warhead impediment and explosively forged penetration system comprising:

a warhead assembly;

a case;

an explosive initiation train mounted to the back of the case;

a liner mounted at the front of the case disposed between the case and warhead assembly; said liner having a central section, an intermediate section and a peripheral section; the axial velocity of said sections being approximately equal, the axial thickness of said sections decreasing from the central to the peripheral section; the radial velocity increasing from the central to the peripheral section; and the line profile angle decreasing from the central to the peripheral section; to define an inwardly directed centrally focused force for forging the penetrator from the liner substantially independently of the axial velocities.

22. The explosively forged elongated penetrator of claim 21 in which said liner has two surfaces, a convex surface and a concave surface.

23. The explosively forged elongated penetrator of claim 22 in which said liner is crescent shaped.

24. The explosively forged elongated penetrator of claim 22 in which said liner is concave in the direction of forward motion of the penetrator.

25. The explosively forged elongated penetrator of claim 22 in which said surfaces are circular arcs.

26. The explosively forged elongated penetrator of claim 22 in which said surfaces are defined by a sixth order quadratic equation.

27. The explosively forged elongated penetrator of claim 21 in which said axial velocities at the central, intermediate and peripheral sections are from 2 km/sec to 3 km/sec, 2 km/sec to 3 km/sec, and 2 km/sec to 3 km/sec, respectively.

28. The explosively forged elongated penetrator of claim 21 in which said axial thicknesses at the central, intermediate and peripheral sections are from 0.15 cm to 0.51 cm, 0.13 cm to 0.46 cm, and 0.07 cm to 0.38 cm.

29. The explosively forged elongated penetrator of claim 21 in which said radial velocities at the central, intermediate and peripheral sections are from 0 km/sec to 0.1 km/sec, 0.3 km/sec to 0.5 km/sec, and 0.4 km/sec to 0.7 km/sec.

30. The explosively forged elongated penetrator of claim 21 in which said line profile angles at the central, intermediate and peripheral sections are from 90° to 80°, 80° to 60°, and 80° to 50°.

* * * * *